United States Patent [19]

Ebi et al.

[11] 4,268,157

[45] May 19, 1981

[54] TONER IMAGE TRANSFER METHOD AND APPARATUS FOR ELECTROSTATIC PHOTOGRAPHY

[75] Inventors: Yutaka Ebi; Koji Hirakura; Fuyuhiko Matsumoto; Wasaburo Ohta; Satoru Tomita, all of Tokyo, Japan

[73] Assignee: Ricoh Company, Ltd., Tokyo, Japan

[21] Appl. No.: 937,637

[22] Filed: Aug. 28, 1978

Related U.S. Application Data

[62] Division of Ser. No. 693,441, Jun. 7, 1976, abandoned.

[30] Foreign Application Priority Data

Jun. 20, 1975 [JP] Japan ..... 50/75316

[51] Int. Cl.[3] ..... G03G 15/00

[52] U.S. Cl. ..... 355/3 TR; 355/3 CH; 430/126

[58] Field of Search ..... 355/3 TR, 3 R, 3 CH, 355/16, 3 SH; 96/1.4

[56] References Cited

U.S. PATENT DOCUMENTS 3,627,523 12/1971 Shelffo ..... 96/1.4
3,697,170 10/1972 Bhagat et al. ..... 96/1.4 X
3,751,156 8/1973 Szostak et al. ..... 96/1.4 X
3,830,589 8/1974 Allen ..... 96/1.4 X
3,837,741 9/1974 Spencer ..... 96/1.4 X
3,924,943 12/1975 Fletcher ..... 96/1.4 X

*Primary Examiner*—R. L. Moses
*Attorney, Agent, or Firm*—Jordan and Hamburg

[57] ABSTRACT

A photoconductive drum is formed with a photoconductive dielectric layer for producing an electrostatic image and an endless transfer belt is formed with a dielectric layer thereon. A toner substance is applied to the drum to produce a toner image, and a copy sheet is pressed between the belt and drum to transfer the toner image to the copy sheet. An electric potential of the same polarity as the electrostatic image is applied to the copy sheet to attract the toner from the drum onto the copy sheet. The potential has a magnitude which is slightly less than a magnitude at which charge transfer from the belt to the drum occurs due to dielectric breakdown through the copy sheet or field emission from the copy sheet to the drum which would degrade the electrostatic image. The method enables a large number of copies to be produced from a single electrostatic image through repeated development and transfer.

4 Claims, 6 Drawing Figures

TONER IMAGE TRANSFER METHOD AND APPARATUS FOR ELECTROSTATIC PHOTOGRAPHY

This is a division of Ser. No. 693,441 now abandoned filed June 7, 1976.

BACKGROUND OF THE INVENTION

The present invention relates to a toner image transfer method and apparatus for electrostatic photography which enables a large number of copies to be produced from a single electrostatic image through repeated development and transfer.

In a known electrostatic copying apparatus, an electrically conductive grounded drum is formed with a photoconductive dielectric layer on its periphery. The drum is charged with an electric potential and is irradiated with a light image which causes conduction in the bright image areas to dissipate the electrostatic charge and form an electrostatic image. This image is developed by applying a toner substance to the drum, and the toner is transferred to a copy sheet and thermally fixed thereto.

As long as the interior of the copying apparatus is shielded from light except for an imaging exposure, an electrostatic image formed thereby will be stable for a long time. The process thereby has the potential of producing a large number of copies from a single electrostatic image through repeated development and transfer. Imaging the drum only once for a number of copies greatly increases the copying speed.

However, known copying machines are only able to produce a few usable copies from a single electrostatic image since the electrostatic image is degraded during the transfer step.

In order to facilitate transfer of the toner image from the drum to the copy sheet, it is desirable to provide a transfer roller or belt which presses the copy sheet between itself and the drum for toner transfer. The belt is electrically conductive and is empressed with an electric potential having the same polarity as the electrostatic image on the drum to attract the toner from the drum to the copy sheet. The electric potential is made as large as is practical in order to effect complete transfer. However, a problem exists in known copying apparatus in that charge transfer occurs between the belt and the drum during the image transfer step which degrades the electrostatic image on the drum to the extent that only a few copies may be produced from a single electrostatic image. Since the copy sheets are made of paper comprising many entangled fibers of a dielectric material with many interstitial spaces between the fibers, the electric charge on the belt is partially transferred to the drum through dielectric breakdown through the copy sheet to degrade the electrostatic image.

It is further known in the art to ground the belt and provide a dielectric layer on the periphery thereof which is electrified by corona discharge. This expedient has not overcome the charge transfer phenomemon. If the potential on the belt is reduced to prevent charge transfer, the result is insufficient transfer of the toner image. If the pressure between the copy sheet and the drum is increased to facilitate toner transfer, the toner is smudged to an extent that the image quality of the copy is unacceptable.

SUMMARY OF THE INVENTION

It is an object of the present invention to provide a toner image transfer method for electrostatic photography which overcomes the drawbacks of the prior art.

It is another object of the present invention to provide a toner image transfer apparatus embodying the above method.

It is another object of the present invention to provide a toner image transfer method in which a copy sheet is lightly pressed against a photoconductive drum carrying a toner image thereon by a belt having a dielectric layer formed on the periphery thereof. The belt and drum move together in the area of contact, and an electric potential is applied to the belt which is just less than a magnitude at which charge transfer from the belt to the drum occurs due to dielectric breakdown through the copy sheet or field emission from the copy sheet to the drum.

It is another object of the present invention to provide a toner image transfer method for electrostatic photography which enables a large number of copies to be made from a single electrostatic image.

It is another object of the present invention to provide a toner image transfer method for electrostatic photography which greatly increases the process speed compared to known methods.

Other objects, together with the foregoing, are attained in the embodiments described in the following description and illustrated in the accompanying drawings.

DESCRIPTION OF THE PREFERRED EMBODIMENTS

While the toner image transfer method and apparatus of the present invention are susceptible of numerous physical embodiments, depending upon the environment and requirements of use, substantial numbers of the herein shown and described embodiments have been made, tested and used, and all have performed in an eminently satisfactory manner.

Figure 1:
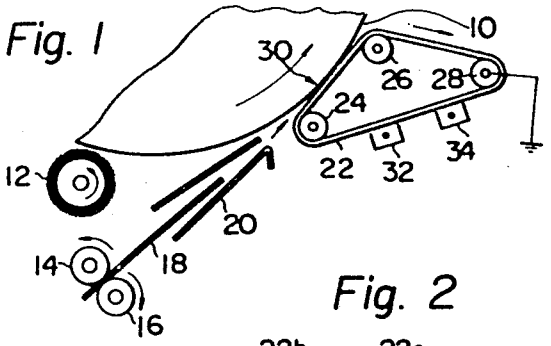
FIG. 1 is a schematic view of a toner image transfer apparatus embodying the present invention.

Referring now to FIG. 1 of the drawing, a photoconductive drum 10 is driven for counterclockwise rotation by drive means (not shown). In a known manner, the surface of the drum 10 is charged with, for example, a negative potential, and a light image of an original document is radiated onto the surface of the drum 10 to form an electrostatic image. A magnetic brush 12 is rotated to brushingly contact the surface of the drum 10 to apply a toner substance to the drum 10 to develop the electrostatic image into a toner image.

A copy sheet 18 made of paper is fed by feed rollers 14 and 16 through a guide 20 into contact with the drum 10 to transfer the toner image to the sheet 18. The feed rollers 14 and 16 are drivingly energized in synchronization with the drum 10 so that the leading edge of the sheet 18 mates with the leading edge of the toner image on the drum 10. An endless belt 22 is trained around rollers 24, 26 and 28 and driven clockwise at a speed so that the drum 10 and belt 22 move in the same direction and at the same speed in a mutually adjacent area 30. The belt 22 is formed of an electrically conductive material and the roller 28 is grounded thereby grounding the belt 22 through ohmic contact. As will be described in detail below, the belt 22 is formed with a dielectric layer on its periphery which is charged with an electric potential of the same polarity (negative) as the electrostatic image by a corona charging unit 32. A corona discharging unit 34 is provided to dissipate the electric charge on the belt 22 prior to charging by the charging unit 32. A positive potential or an alternating potential may be applied to the belt 22 by the corona discharging unit 34.

The copy sheet 18 is adapted to be lightly pressed against the drum 10 by the belt 22 to transfer the toner image from the drum 10 to the sheet 18. Since the drum 10 and belt 22 move at the same speed, the sheet 18 will be fed thereby without smearing the toner image. The electrostatic charge on the belt 22 applied through the back side of the copy sheet 18 attracts the toner to the sheet 18 from the drum 10.

Figure 2:
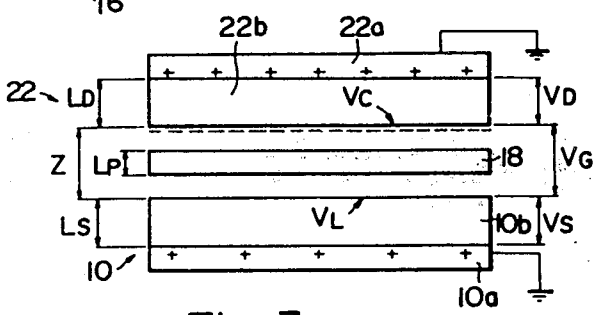
FIG. 2 is a schematic cross section of a photoconductive drum, a transfer belt and a copy sheet illustrating the principles of the present invention.

Referring now to FIG. 2, the drum 10, sheet 18 and belt 22 are shown as flattened out in order to disclose the principles of the present invention in a simplified manner. The drum 10 comprises an electrically conductive core 10*a* which is grounded and a photoconductive dielectric layer 10*b* formed on the periphery of the core 10*a*. The belt 22 similarly comprises a grounded electrically conductive backing 22*a* on the periphery of which is formed a dielectric layer 22*b*.

To simplify the explanation of the charge transfer phenomenon between the belt 22 and the drum 10, the magnitude of the electrostatic image on the drum 10 will be temporarily considered as being zero.

The negative electric potential applied to the dielectric layer 22*b* of the belt 22 induces positive potentials at the interfaces of the core 10*a* of the drum 10 and the backing 22*a* of the belt 22. The surface charge density on the dielectric layer 22*b* is designated as $\sigma$, the surface charge density at the interface of the backing 22*a* and dielectric layer 22*b* is designated as $\sigma_1$ and the surface charge density at the interface or the core 10*a* and dielectric layer 10*b* is designated as $\sigma_2$. The relation $$\sigma = \sigma_1 + \sigma_2 \tag{1}$$

must hold.

The thickness of the dielectric layer 10*b*, the copy sheet 18 and the dielectric layer 22*b* are designated as $L_S$, $L_P$ and $L_D$ respectively, and the gap between the dielectric layers 10*b* and 22*b* is designated as Z. The potential difference across the dielectric layer 10*b*, the gap Z and the dielectric layer 22*b* are designated as $V_S$, $V_G$ and $V_D$ respectively. Since the core 10*a* and backing 22*a* are grounded, the relation $$V_D + V_G + V_S = 0 \tag{2}$$

must hold.

Assuming temporarily that the copy sheet 18 is removed from the gap Z, the potential differences $V_D$, $V_G$ and $V_S$ are given as $$V_D = \frac{\sigma_1}{K_D E_O} L_D \tag{3}$$

$$V_G = \frac{\sigma_2}{R_O} Z \tag{4}$$

$$V_S = \frac{\sigma_2}{K_S E_O} L_S \tag{5}$$

where $K_D$ and $K_S$ are the dielectric constants of the dielectric layers 22*b* and 10*b* respectively and $E_O$ is the dielectric constant for a vacuum.

The surface potential at the surface of the dielectric layer 22*b* which is electrified by the corona charging unit 32 is designated as $V_C$ and has the value $$V_C = \frac{\sigma}{K_D E_O} L_D \tag{6}$$

Combining equations (4) and (5) produces $$V_S = \frac{V_G L_S}{K_S Z} \tag{7}$$

Combining equations (1), (3) and (4) produces $$V_D = -V_C + \frac{V_G L_D}{K_D Z} \tag{8}$$

Combining equations (7), (8) and (2) produces $$V_G = \frac{V_C Z}{\frac{L_S}{K_S} + \frac{L_D}{K_D} + Z} \tag{9}$$

Figure 3:
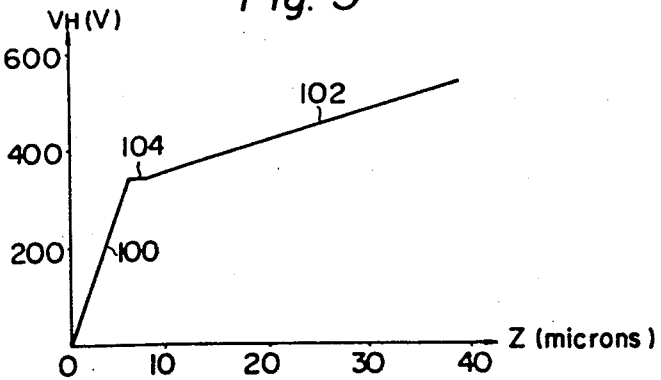
FIG. 3 is a graph illustrating the principle of charge transfer which is eliminated by the present invention.

FIG. 3 illustrates the relationship between the voltage $V_H$ in volts required to cause transfer of charge between the dielectric layers 10*b* and 22*b* when they are separated by air as a function of the gap Z in microns. In a portion of the curve designated as 100, in which Z is less than 8 microns, charge transfer is by field emission. For values of Z greater than about 8 microns, charge transfer is by dielectric breakdown of the air as indicated by a curve portion 102. The curve has a flat portion around 8 microns designated as 104.

The charge transfer in the dielectric breakdown portion 102 will be analyzed first. In this region, the dielectric breakdown voltage of air is given by Paschen's relation and designated as $V_B$ as follows $$V_B = 312 + 6.2Z \tag{10}$$

Dielectric breakdown will occur if $V_G$ is greater than $V_B$ with the resulting transfer of charge from the belt 22 to the drum 10 to cause degradation of the electrostatic image on the drum 10.

Figure 4:
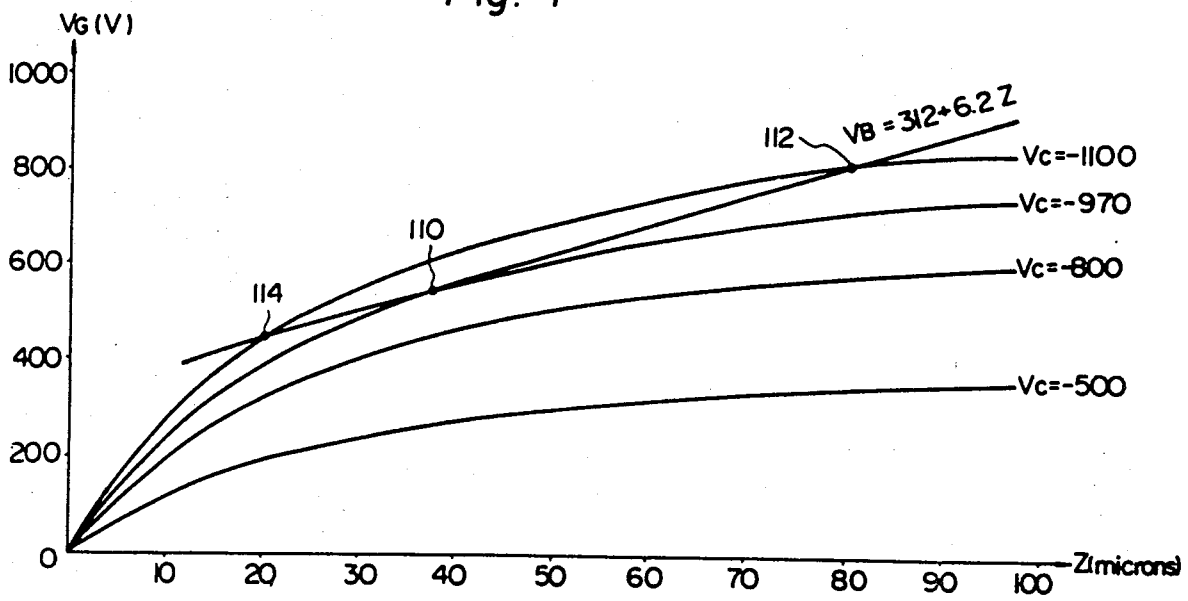
FIG. 4 is a graph further illustrating the phenomenon of charge transfer.

FIG. 4 illustrates equation (9) plotted with Z as the independent variable for various values of $V_C$. In this example, the dielectric layer 10*b* of the drum 10 is a OPC organic semiconductor material (polyvinyl carbazol) having a dielectric constant $K_S = 3$ and a thickness $L_S = 13$ microns. The dielectric layer 22*b* of the belt 22 in MYLAR (trade name) having a dielectric constant $K_D = 3$ and a thickness $L_D = 75$ microns.

Also plotted in FIG. 4 is equation (10). Since dielectric breakdown only occurs when $V_G$ is greater than $V_B$, there will be no dielectric breakdown for any value of Z greater than 8 microns for the curves at which $V_C$ is held at −500 V and −800 V, since these curves lie below the line representing equation (10) for all values of Z. A threshold value $V_{CO}$ may be defined as the value of $V_C$ for which a curve of equation (9) will be tangent to the curve of equation (10), or for which there will be only one value of Z for which $V_B = V_G$ at which dielectric breakdown will occur. To find this threshold value $V_{CO}$, equation (9) is set equal to equation (10) and rearranged to produce $$6.2Z^2 - (V_C - 312 - 6.2D)Z + 312D = 0 \quad (11)$$

where $$D = \frac{L_S}{K_S} + \frac{L_D}{K_D}$$

Taking the discriminant of equation (11) and setting it equal to zero produces $V_{CO}$, which is the value at which two real roots of equation (11) coincide $$(V_C - 312 - 6.2D)^2 - 4(6.2)(312D) = 0 \quad (12)$$

Solving equation (12) produces the desired value of $V_{CO}$ $$V_{CO} = \sqrt{7737.6D} + 312 + 6.2D \quad (13)$$

In the present example, $D \simeq 29.3$ and $V_{CO}$ has the numerical value of $V_{CO} \simeq 970$ V. In FIG. 4, it will be seen that the curve of equation (9) for which $V_C$ is held at 970 V is tangent to the line representing equation (10) at a point 110. Dielectric breakdown will occur at only one value of Z which is obtained by solving equation (11) for Z and substituting the value of $V_{CO}$. This value of Z is designated as $Z_B$ and has the value $$Z_B = \frac{\sqrt{7737.6D}}{12.4} \quad (14)$$

In this particular example, $Z_B \simeq 38.4$ microns. Thus, dielectric breakdown between the dielectric layers **10*b* and 22*b* can be positively prevented by maintaining $V_C$, the potential applied to the dielectric layer 22*b* of the belt 22, slightly lower than $V_{CO}$. The value of the potential $V_G$ between the dielectric layers 10*b* and 22*b*** at which dielectric breakdown occurs is obtained by solving equation (9) for $V_{CO}$ and $Z_B$, and has the value of $V_G \simeq 550.2$ V in this example.

For any value of Z less than or equal to $Z_B$, the potential $V_C$ must be less than $V_{CO}$ to prevent dielectric breakdown in this simplified case. However, if Z is greater than $Z_B$, the potential $V_C$ may be increased by an amount corresponding to the value of Z. Specifically, for values of $V_C$ greater than $V_{CO}$, equation (11) will have two positive roots. This is illustrated by the curve for $V_C = -1100$ V in FIG. 4 which intersects the curve of equation (10) at an upper point 112 and a lower point 114. At the upper point 112, $Z \simeq 80$ microns and at the lower point 114 $Z \simeq 18$ microns. Dielectric breakdown will occur for all values of Z between 18 microns and 80 microns.

It will be assumed that the desired design value of Z is equal to 80 microns. The point 114 does not represent any useful value, but the point 112 represents the value of $V_C$ for $Z = 80$ microns above which dielectric breakdown will occur which is designated as $V_{Cl}$ and is obtained from equation (11) for the desired value of Z, which in this example is 80 microns, as follows $$V_{Cl} = \frac{(312 + 6.2Z)(D + Z)}{Z} \quad (15)$$

Solution of equation (15) for $Z = 80$ microns produces $V_{C1} \simeq 1100$ V.

In actual practice, the copy sheet 18 has a thickness $L_P$ and a dielectric constant $K_P$ which is greater than unity; for example, $K_P = 3$. If the gap Z is substantially equal to the thickness $L_P$ of the copy sheet 18, the voltage $V_C$ may be increased to a value $V_{C2}$ greater than $V_{C1}$ without causing dielectric breakdown and resulting charge transfer. This value is obtained by modifying equation (13) to include the thickness $L_P$ and the dielectric constant $K_P$ of the copy sheet 18 as follows $$V_{C2} = \sqrt{7737.6D_1} + 312 + 6.2D_1 \quad (16)$$

In this case $$D_1 = \frac{L_D}{K_D} + \frac{L_S}{K_S} + \frac{L_P}{K_P} \quad (17)$$

In this example, equation (16) gives a value of $V_{C2} \simeq 1136$ V.

In practice, the voltage $V_C$ may be increased slightly above $V_{C2}$, since the electrostatic image on the drum 10 has a magnitude greater than zero. Although the effect of the electrostatic image is rather complicated to analyze, a good approximation is obtained by considering that the value of $V_C$ may be made higher than $V_{C2}$ by a value equal to the electrostatic potential $V_L$ of the portions of the electrostatic image on the drum 10 which correspond to the brightest or white portions of the light image. The magnitude of the electrostatic image on the drum 10 is minimum in these areas. Equation (16) may thereby be modified to provide an increased value $V_{C3}$ which provides for the electrostatic image on the drum 10 as follows $$V_{C3} = \sqrt{7737.6D_1} + 312 + 6.2D_1 + V_L \quad (18)$$

The equations presented thus far apply to dielectric breakdown through the copy sheet 18. It is also necessary to ensure that field emission between the copy sheet 18 and the drum 10 will not occur. If $Z_1$ represents the gap between the copy sheet 18 and the dielectric layer **10*b* of the drum *10**, the potential $V_{G1}$ across the gap $Z_1$ is given as $$V_{G1} = \frac{V_C Z_1}{D_1 + Z_1} \quad (19)$$

For values of $Z_1$ less than 8 microns, the curve portion 100 of FIG. 3 is given by Hobbes as $$V_H = 75Z_1 \quad (20)$$

and the curve portion 104 is $$V_H = 350 \text{ volts} \quad (21)$$

Charge transfer due to field emission will occur in the region of FIG. 3 above the curve portion 100. Field emission will occur when $V_C$ is above a value $V_{C4}$ which is given by $$V_{C4} = 75\left(\frac{L_S}{K_S} + \frac{L_D}{K_D} + \frac{L_P}{K_P} + Z_1\right) = 75(D_1 + Z_1) \quad (22)$$

With the copy sheet 18 in pressing contact with the drum 10, the value of $Z_1$ is close to zero. In the present example, with $Z_1$ taken as zero, $V_{C4}$ has the value of $V_{C4} \simeq 4200$ V.

The value of $V_C$ which is applied to the dielectric layer 22b of the belt 22 is selected slightly below a value at which charge transfer occurs to the drum 10 by either dielectric breakdown through the copy sheet 10 or field emission from the copy sheet 18. The value of $V_C$ is therefore selected so as to be slightly lower than whichever of $V_{CO}$, $V_{C1}$, $V_{C2}$ and $V_{C3}$ has the highest value, while ensuring that said value is below $V_{C4}$. If the copy sheet 18 is provided with a plastic filler or the like which fills the interstitial spaces between the fibers, the values of $V_{CO}$ and $V_{C1}$ need not be considered.

Figure 5:
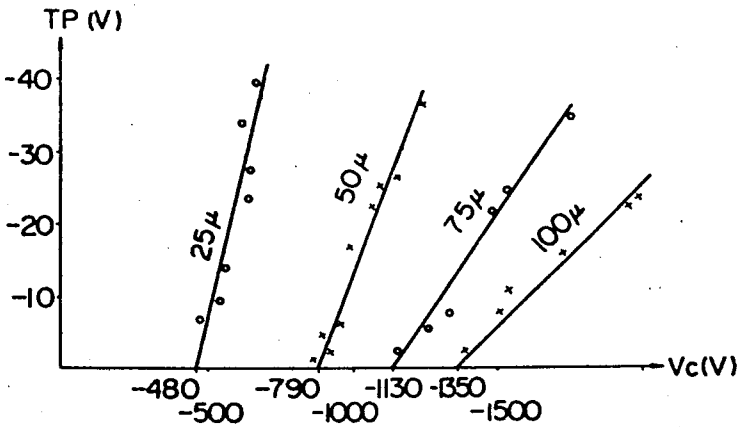
FIGS. 5 and 6 are graphs illustrating the performance of the present invention.

The calculations presented above have been proven accurate by numerous experiments. An organic photosemiconductor KALLE K-1 RY-6 (trade name) having the values $K_S=3$ and $L_S=13$ microns was used for the dielectric layer 10b of the drum 10 and TEFLON (trademark) and polyester films with $K=2$ and $K=3$ respectively were used for the dielectric layer 22b of the belt 22. The copy sheet 18 had the values $K_P=3$ and $L_P=80$ microns. The results for the polyester films are shown in FIG. 5, with various values of the thickness $L_D$ of the dielectric layer 22b of the belt 22 being tested, specifically 25, 50, 75 and 100 microns. For these tests, no electrostatic image was formed on the drum 10 and the drum 10 was discharged prior to testing.

The ordinate represents a transfer potential TP which is induced on the dielectric layer 10b of the drum 10 due to charge transfer as a function of $V_C$. The intersections of the curves with the abcissa represent the value of $V_C$ at which charge transfer occurs. Of particular interest is the intersection of the curve for $L_D=75$ microns at a value of $V_C=-1130$ volts. The correlation with the value of $V_{C2} \simeq 1136$ volts calculated using equation (16) is extremely close and accurate for practical purposes. Since the voltage $V_{C4}$ above which charge transfer due to field emission occurs is much higher than the value $V_{C2}$ associated with dielectric breakdown, the value $V_{C2}$ or the value $V_{C3}$ should be used as the value of applied $V_C$. It has also been determined experimentally that the calculated value of applied $V_C$ provides effective transfer of the toner image to the copy sheet 18. In further tests in which the calculated values of $V_C$ were utilized, over 100 copies of good quality were produced from a single electrostatic image.

Figure 6:
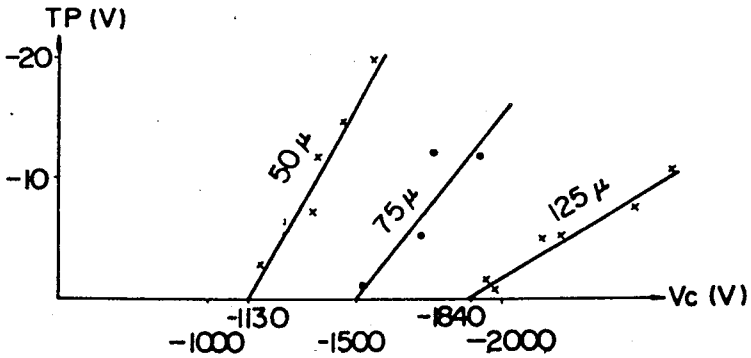

The results for the tests of the TEFLON dielectric layers 22b are shown in FIG. 6, with the values of $L_D$ being 50, 75 and 125 microns.

Various combinations of the materials of the dielectric layers 10b and 22b which have been tested and found suitable for practical use are disclosed in the following. A large number of good quality copies (over 100) were produced from a single electrostatic image in each case.

-continued

1. Dielectric layer 10b of the drum 10 : organic photosemiconductor KALLE
   K-1 RY-6 (trade name) 13 microns thick
   Dielectric layer 22b of the belt 22: MYLAR (trademark) film 75 microns thick
   Voltage $V_C$: −1050 to −1150 volts
2. Dielectric layer 10b: same as case 1
   Dielectric layer 22b: MYLAR 50 microns thick
   $V_C$: −1000 volts
3. Dielectric layer 10b: same as case 1
   Dielectric layer 22b: MYLAR 100 microns thick
   $V_C$: −1250 to −1350 volts
4. Dielectric layer 10b: same as case 1
   Dielectric layer 22b: TEFLON 125 microns thick
   $V_C$: −1500 volts
5. Dielectric layer 10b: same as case 1
   Dielectric layer 22b: TEFLON 250 microns thick
   $V_C$: −2000 volts
6. Dielectric layer 10b: same as case 1
   Dielectric layer 22b: TEFLON 500 microns thick
   $V_C$: −3000 volts
7. Dielectric layer 10b: selenium 50 microns thick
   Dielectric layer 22b: MYLAR 75 microns thick
   $V_C$: −1100 volts The disclosed embodiment comprising the endless belt 22 is advantageous for high speed copying since the belt 22 can be provided in contact with the drum 10 over a rather large area to increase the transfer time. In such a case, a problem of axial movement of the belt 22 which would cause smearing of the toner image can be prevented by forming perforations in the sides of the belt 22 in which engage sprockets.

It will be understood that the scope of the present invention is not limited to a dry electrostatic process but may be adapted to a wet process as well. Other modifications within the scope of the invention will become possible for those skilled in the art after receiving the teachings of the present disclosure.

What is claimed is:

1. An electrostatographic apparatus for increasing the number of copies produced from a single electrostatic image through repeated development and transfer comprising:

a photoconductive member having a photoconductive dielectric layer for formation of an electrostatic image and development of the electrostatic image by means of a toner substance to form a toner image;

a transfer member having a dielectric layer to press a copy sheet between the dielectric layers of the photoconductive member and transfer member to transfer the toner image to the copy sheet; and charging means to apply an electric potential to the dielectric layer of the transfer member of the same polarity as the electrostatic image on the photoconductive member, the electric potential having a magnitude less than the magnitude at which charge transfer between the dielectric layers occurs due to dielectric breakdown through the copy sheet and field emission from the copy sheet, preferably in the range of 480 to 3000 volts, the thickness and dielectric constant of the dielectric layer of the transfer member and of the photoconductive member and thickness and dielectric constant of the copy sheet being selected according to a predetermined relationship such that the magnitude of the electric potential is less than:

$$\sqrt{7737.6D_1} + 312 + 6.2D$$

-continued $$\text{where } D_1 = \frac{L_D}{K_D} + \frac{L_S}{K_S} + \frac{L_p}{K_p}$$

$$D = \frac{L_D}{K_D} + \frac{L_S}{K_S}$$

$L_D$ is the thickness of the dielectric layer of the transfer member;

$K_D$ is the dielectric constant of the dielectric layer of the transfer member;

$L_S$ is the thickness of the dielectric layer of the photoconductive member;

$K_S$ is the dielectric constant of the dielectric layer of the photoconductive member;

$L_P$ is the thickness of the copy sheet; and $K_P$ is the dielectric constant of the copy sheet.

2. An apparatus as in claim 1, in which the photoconductive member is in the form of a drum having the dielectric layer formed on the periphery thereof.

3. An apparatus as in claim 1, further comprising discharging means to dissipate an electric charge on the dielectric layer.

4. An electrostatographic apparatus for increasing the number of copies produced from a single electrostatic image through repeated development and transfer comprising:

a photoconductive member having a photoconductive dielectric layer for formation of an electrostatic image and development of the electrostatic image by means of a toner substance to form a toner image;

a transfer member having a dielectric layer to press a copy sheet between the dielectric layers of the photoconductive member and transfer member to transfer the toner image to the copy sheet; and charging means to apply an electric potential to the dielectric layer of the transfer member of the same polarity as the electrostatic image on the photoconductive member, the electric potential having a magnitude less than the magnitude at which charge transfer between the dielectric layers occurs due to dielectric breadown through the copy sheet and field emission from the copy sheet, preferably in the range of 480 to 3000 volts, the thickness and dielectric constant of the dielectric layer of the transfer member and of the photoconductive member and the thickness and dielectric constant of the copy sheet being selected according to a predetermined relationship such that the magnitude of the electric potential is less than:

$$\sqrt{7737.6D_1} + 312 + 6.2D_1 + V_L$$

where $$D_1 = \frac{L_D}{K_D} + \frac{L_S}{K_S} + \frac{L_P}{K_P}$$

$L_D$ is the thickness of the dielectric layer of the transfer member;

$K_D$ is the dielectric constant of the dielectric layer of the transfer member;

$L_S$ is the thickness of the dielectric layer of the photoconductive member;

$K_S$ is the dielectric constant of the dielectric layer of the photoconductive member;

$L_P$ is the thickness of copy sheet;

$K_P$ is the dielectric constant of the copy sheet; and $V_L$ is the electric potential of a portion of the electrostatic image having the lowest magnitude.

* * * * *